United States Patent [19]

Biscoe et al.

[11] 4,415,147

[45] Nov. 15, 1983

[54] SEATING SPRING ASSEMBLY AND METHOD

[75] Inventors: Thomas S. Biscoe, Columbia; Rodney S. Taylor, Folsom, both of Pa.

[73] Assignee: Simmons Universal Corporation, New York, N.Y.

[21] Appl. No.: 310,145

[22] Filed: Oct. 9, 1981

[51] Int. Cl.[3] ..... A47C 7/30

[52] U.S. Cl. ..... 267/111; 297/452; 29/460

[58] Field of Search ..... 267/110, 111, 131, 142, 267/144, 158, 165, 90; 29/418, 460; 228/175, 182, 191; 297/284, 452, 456, 457; 118/423

[56] References Cited

U.S. PATENT DOCUMENTS

| | | | |
|---|---|---|---|
| 2,058,165 | 10/1936 | McCoy | 267/142 |
| 2,094,041 | 9/1937 | Lee et al. | 297/456 |
| 2,803,293 | 8/1957 | Rowland | 267/111 |
| 3,252,263 | 5/1966 | Korf | 29/460 |
| 3,487,481 | 1/1970 | Richardson et al. | 297/456 |
| 3,707,033 | 12/1972 | Knott | 29/460 |
| 3,709,559 | 1/1973 | Rowland | 267/111 |
| 3,720,568 | 3/1973 | Rowland | 267/111 |
| 3,767,261 | 10/1973 | Rowland | 297/452 |
| 3,774,967 | 11/1973 | Rowland | 267/111 |
| 3,843,477 | 10/1974 | Rowland | 297/452 |
| 3,886,646 | 6/1975 | Broderson | 228/182 |
| 4,286,898 | 9/1981 | Stafford | 29/460 |

*Primary Examiner*—Douglas C. Butler
*Assistant Examiner*—R. R. Diefendorf
*Attorney, Agent, or Firm*—Bell, Seltzer, Park & Gibson

[57] ABSTRACT

The seating spring assembly includes a series of elongate sinuous spring wires with each of the wires touching each of the adjacent spring wires at frequent intervals along their length. Frangible welds, in the form of spot welding, are provided at spaced apart touching locations along the lengths of the wires to temporarily secure the adjacent spring wires together. A sleevelike plastic coating surrounds the wires and the frangible welds are broken when the seat is occupied by a person so that the plastic coating then constitutes the sole element holding the spring wires together and the full flexibility and comfort of the seating spring assembly is retained.

8 Claims, 5 Drawing Figures

30
10
11
12
13
14
15
16
25
53
46
57
43
44
41
42
45
40
50
51
52
55
56
60
61
62
63
64
65
66
67
68
69

SEATING SPRING ASSEMBLY AND METHOD

FIELD OF THE INVENTION

This invention relates generally to a seating spring assembly of the type which includes a series of elongate sinuous spring wires with each of the wires touching each of its adjacent wires at frequent intervals along their lengths, and a sleevelike plastic coating surrounding the wires and connecting together adjacent portions of adjacent wires so that the assembly is held together by the plastic coating without substantially restraining the flexing of the spring wires, and more particularly to such a spring assembly in which adjacent spring wires are temporarily secured together by frangible weld means to maintain the spring wires in proper relationship while the plastic coating is applied thereto.

BACKGROUND OF THE INVENTION

It is known to form seating spring assemblies by applying a plastic coating to a series of elongate sinuous spring wires which are positioned in adjacent relationship to each other with each of the wires touching each of its adjacent wires at frequent intervals along their lengths. For example, this type of seating spring assembly is disclosed in U.S. Pat. Nos. 3,843,477; 3,774,967; 3,767,261; 3,720,568; 3,709,559; and 2,803,293. As disclosed in these patents, the plastic coating is applied by dipping the spring wire assembly into the plastic coating material while the individual spring wires are held in aligned position with each of the wires touching each of its adjacent wires at frequent intervals along their lengths. The assembly is thereafter held together by the plastic coating without substantially restraining the flexing of the spring wires, and the coating itself provides a stretching and contracting spring action between adjacent wires, thereby giving a two-way stretch action to the spring assembly. This type of spring assembly is particularly useful in forming the seats and backs of chairs and the like.

The spring wires must be maintained in the proper touching relationship while the plastic coating is applied. If any location between adjacent wires is not maintained in the proper position, the plastic coating will not properly interconnect and resiliently hold the adjacent wires together at these locations. However, it is very difficult to hold the entire lengths of adjacent spring wires in the proper touching relationship during the plastic coating process with the result that a large number of the coated spring assemblies must be rejected.

Several different methods have been proposed for maintaining the spring wires in the proper relationship during the plastic coating process. For example, U.S. Pat. No. 3,843,477 discloses a hand-operated tool for holding the spring wires together (FIGS. 19–21) while the spring assembly is dipped into the coating material to apply the plastic coating thereto. This type of tool has been found to be effective in holding the opposite end portions of adjacent spring wires in the proper position but it is not very effective in holding and maintaining the medial portions of adjacent spring wires in the proper position so that a large number of the plastic coated spring assemblies must be rejected.

U.S. Pat. No. 2,803,293 discloses the use of metal clips or bands positioned at spaced apart touching locations along the spring wires and surrounding and holding together adjacent touching portions of adjacent wire springs. These metal clips or bands do hold the adjacent spring wires in the proper locations during application of the plastic coating but are expensive to apply and limit the normal flexing of the spring wires and the normal stretching and contracting of the plastic coating.

U.S. Pat. Nos. 3,720,568 and 3,774,967 (FIG. 29 of both patents) discloses applying a permanent metal weld to join together the opposite end portions of adjacent spring wires of the spring assembly. These permanent welds do maintain the opposite end portions of adjacent spring wires in the proper location; however, they do not maintain the medial portions of adjacent spring wires in the proper location during the plastic coating process. Also, these permanent welds tend to limit flexibility of the opposite edge portions of the spring assembly.

SUMMARY OF THE INVENTION

With the foregoing in mind, it is an object of the present invention to provide a seating spring assembly and method of forming the same which insures that the adjacent sinuous spring wires are temporarily secured together and held in the proper position during the application of the plastic coating thereto and which temporary securement is easily broken when the spring assembly is occupied by a person so that the plastic coating then constitutes the sole means holding the wires of the assembly together and the full flexibility and comfort of the seating spring assembly is retained.

In accordance with the present invention, the seating spring assembly includes a series of elongate sinuous spring wires with each of the spring wires touching each of its adjacent spring wires at frequent intervals along their lengths. Frangible weld means is provided at least at touching locations adjacent each end of adjacent wires and at spaced apart touching locations intermediate opposite ends to temporarily secure together the touching points of adjacent wires. A sleevelike plastic coating surrounds the wires and the frangible weld means and follows the sinousity of the wires to join the wires together where the wires touch so that a unitary spring assembly is provide. The frangible weld means is adapted to be easily broken when the spring assembly is occupied by a person so that the plastic coating then constitutes the sole means holding the wires of the spring assembly together and the full flexibility and comfort of the seating spring assembly is retained.

The seating spring assembly is formed by successively positioning a plurality of elongate sinuous spring wires in adjacent relationship with each wire touching each of its adjacent wires at frequent intervals along their lengths. Spot welds are applied at the touching locations at adjacent ends of adjacent spring wires and at touching locations intermediate opposite ends of adjacent wires to form frangible welds temporarily securing together adjacent wires of the spring assembly. A straight wire is spot welded at spaced apart locations to one endmost spring wire. Dip wires are then secured at their lower ends to the spring assembly and extend upwardly therefrom, preferably in the four corners, and are used to support the spring assembly for applying the sleevelike plastic coating around the wires and the frangible welds, such as by a dipping operation.

The temporary securing together of the touching points of adjacent spring wires to form the spring assembly may be carried out in an economical manner.

The frangible weld means insures that the spring wires are held in the proper positions relative to each other so that a very low number of spring assemblies are rejected for improper coating of the plastic material.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 4:
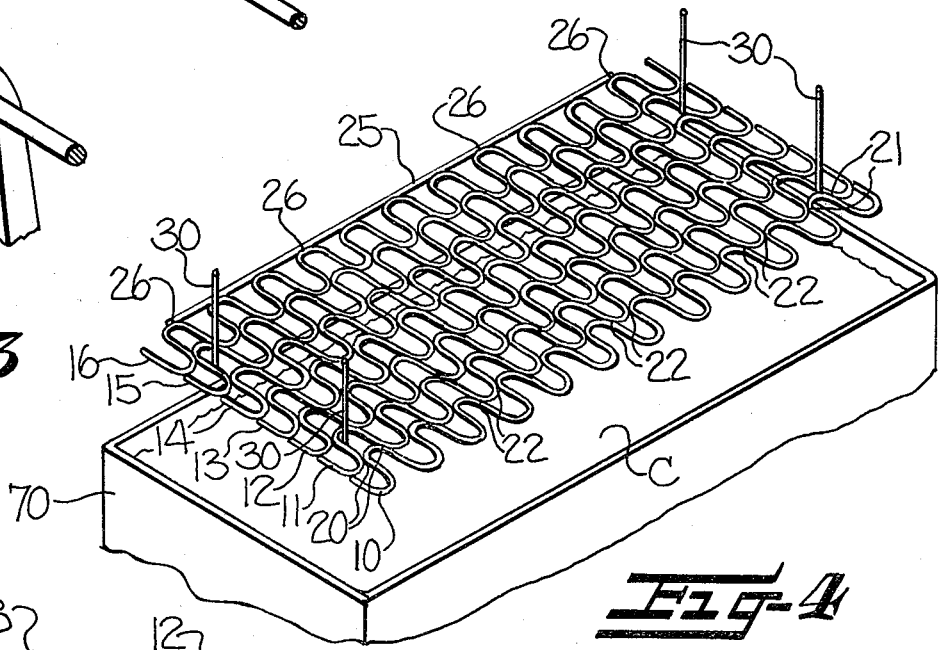
FIG. 4 is an isometric view illustrating one spring assembly positioned to be dipped into a plastic coating material for applying the sleevelike plastic coating thereto.

As best shown in FIG. 4, the present seating spring assembly includes a series of elongate sinuous spring wires 10–16. Each of the wires 10–16 includes a series of reversing U-shaped bends and the wires are nested together so that each of the wires touches each of its adjacent wires at frequent intervals along their lengths, at each of the U-shaped bends. Adjacent wires are spot welded at locations adjacent each end of adjacent wires, as indicated at 20. 21, to provide frangible weld means temporarily securing together the touching locations of adjacent wires. The wires 10–16 are also spot welded at spaced apart touching locations intermediate opposite ends, as indicated at 22, to provide frangible weld means temporarily securing together the touching locations along the medial portions of adjacent wires.

A straight end wire 25 is spot welded, as indicated at 26, at spaced apart touching locations to the endmost sinuous spring wire 16. Thus, the series of elongate sinuous spring wires 10–16 is held together in the proper position with adjacent spring wires touching each other at frequent intervals along their lengths and the adjacent wires 10–16 are temporarily held or secured together at spaced apart locations so that a plastic coating can be applied thereto. In order to provide a convenient means for handling the spring assembly during the application of the plastic coating, such as by dipping, the lower ends of dip stick wires 30 are spot welded to the sinuous spring wires 11, 15 and adjacent each corner of the spring assembly.

Figure 5:
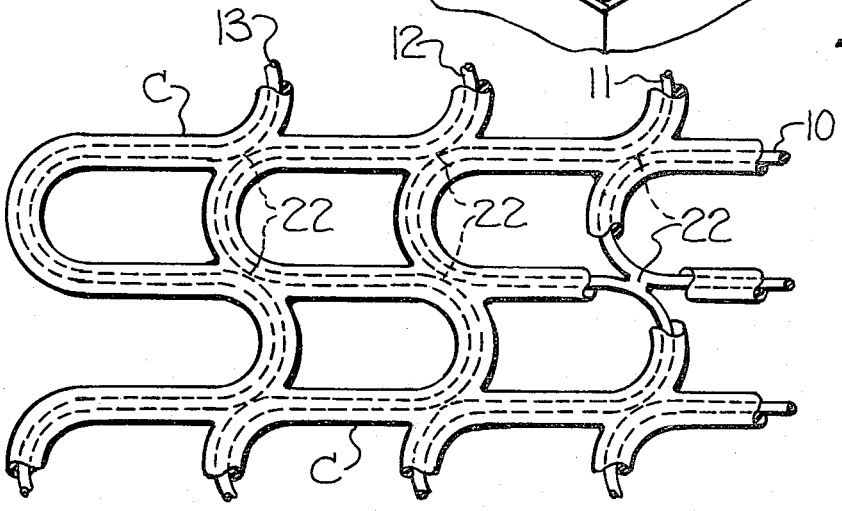
FIG. 5 is a fragmentary plan view of a portion of the spring assembly and with an area of the plastic coating broken away to illustrate the manner in which adjacent spring wires are spot welded together at spaced apart touching locations along their length.

A sleevelike plastic coating, indicated at C, surrounds the sinuous spring wires 10–16 and the end wire 25. As illustrated in FIG. 5, the plastic coating C follows the sinuosity of the wires and joins together the spring wires where they touch each other. Thus, the spring wires, the frangible weld means and the plastic coating form a unitary seating spring assembly.

The spot welds 20, 21 and 22 are sufficiently strong to hold the adjacent wires together during coating of the wires and during assembly of the seat in which the seating spring assembly is to be used. However, the spot welds 20, 21 and 22 are of a sufficiently frangible nature that when the seat is occupied by a person, the spot welds will be broken so that the plastic coating C then constitutes the sole means holding the spring wires 10–16 together and the full flexibility and comfort of the seating spring assembly is retained.

The spot welds are preferably formed by a capacitor discharge welding unit with a high energy output through a very short duration discharge so that there is good puddling at the weld point and without high heat buildup in the metal spring wires. The spot welds must be strong enough to maintain the adjacent spring wires in touching relationship during the coating operation. However, the spot welds must not detrimentally affect the spring characteristics of the spring wires. Also, the spot welds must not be so strong that they will not be broken after the coating operation, and when the seat is occupied by a person.

It has been found that satisfactory spot welds are formed when adjacent wires separate under a tensional force of from about 10 to 20 pounds. The force is applied to pull apart the adjacent wires and the direction of the force is aligned with the direction in which the spot weld was formed. While a tensional force of about 10 to 20 pounds is required to pull the wires apart, it is to be understood that a much smaller torsional or twisting force will break the spot welds. The seat assembly is primarily subjected to forces at right angles to the spot welds when the seat is occupied by a person so that the spot welds are easily broken and the spring wires are retained in position solely by the coating.

The coating C is of a sufficiently resilient nature to permit limited stretching apart of the touching portions of the spring wires when the seat is sat upon. The coating C also serves to contract and to draw the spring wires together when the seat is not occupied.

Various types and sizes of spring wire and coating material may be used to form the spring wire assembly, depending upon the degree of stiffness or flexibility desired in the seat. Various types of spring wires and coating materials are described in the patents referred to above and the present invention is applicable for use with any of the types of spring wires and coating materials described in these patents.

METHOD OF FORMING THE SPRING ASSEMBLY

Figure 2:
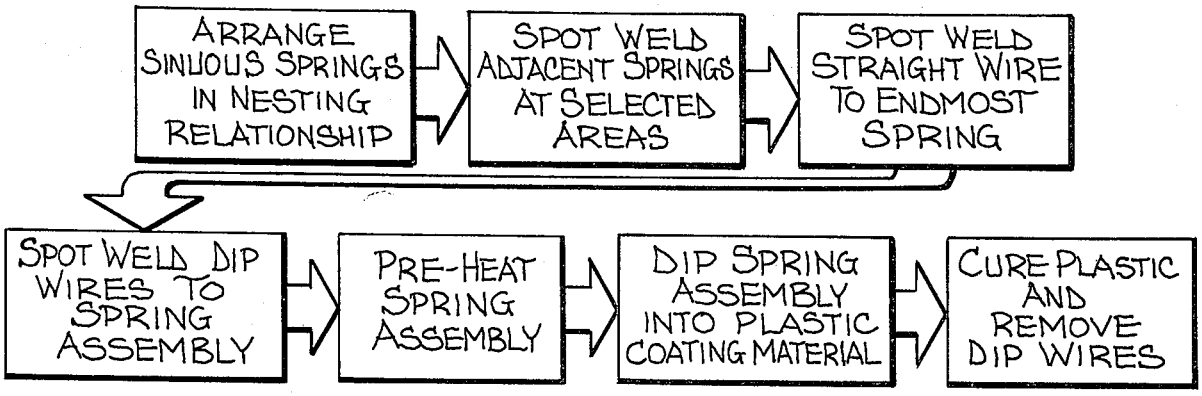
FIG. 2 is a flow diagram illustrating the various steps carried out in forming the seating spring assembly.

As schematically illustrated in FIG. 2, the seating spring assembly is formed by first arranging the sinuous spring wires 10–16 in flat nesting relationship with each wire touching each of its adjacent wires at frequent intervals along their length. The adjacent spring wires are spot welded together at selected locations to temporarily secure together adjacent wires of the spring assembly. The straight end wire 25 is then spot welded to the endmost spring wire 16 and at spaced apart locations. The lower ends of the dip wires 30 are then spot welded to the spring assembly and adjacent each corner thereof. The spring assembly is then preheated to a temperature of approximately 500° F. to prepare the same for application of the plastic coating. The spring assembly is then dipped into the plastic coating material to apply the plastic coating around the wires and the frangible welds so that the plastic coating follows the sinuosity of the wires and joins the spring wires together at each touching location. The coated spring assembly is then heated to cure the plastic coating and the dip wires 30 are removed. The seating spring assembly is then ready for assembly into the frame of the seat in which it is to be used and may be attached thereto in any one of several conventional manners.

Figure 1:
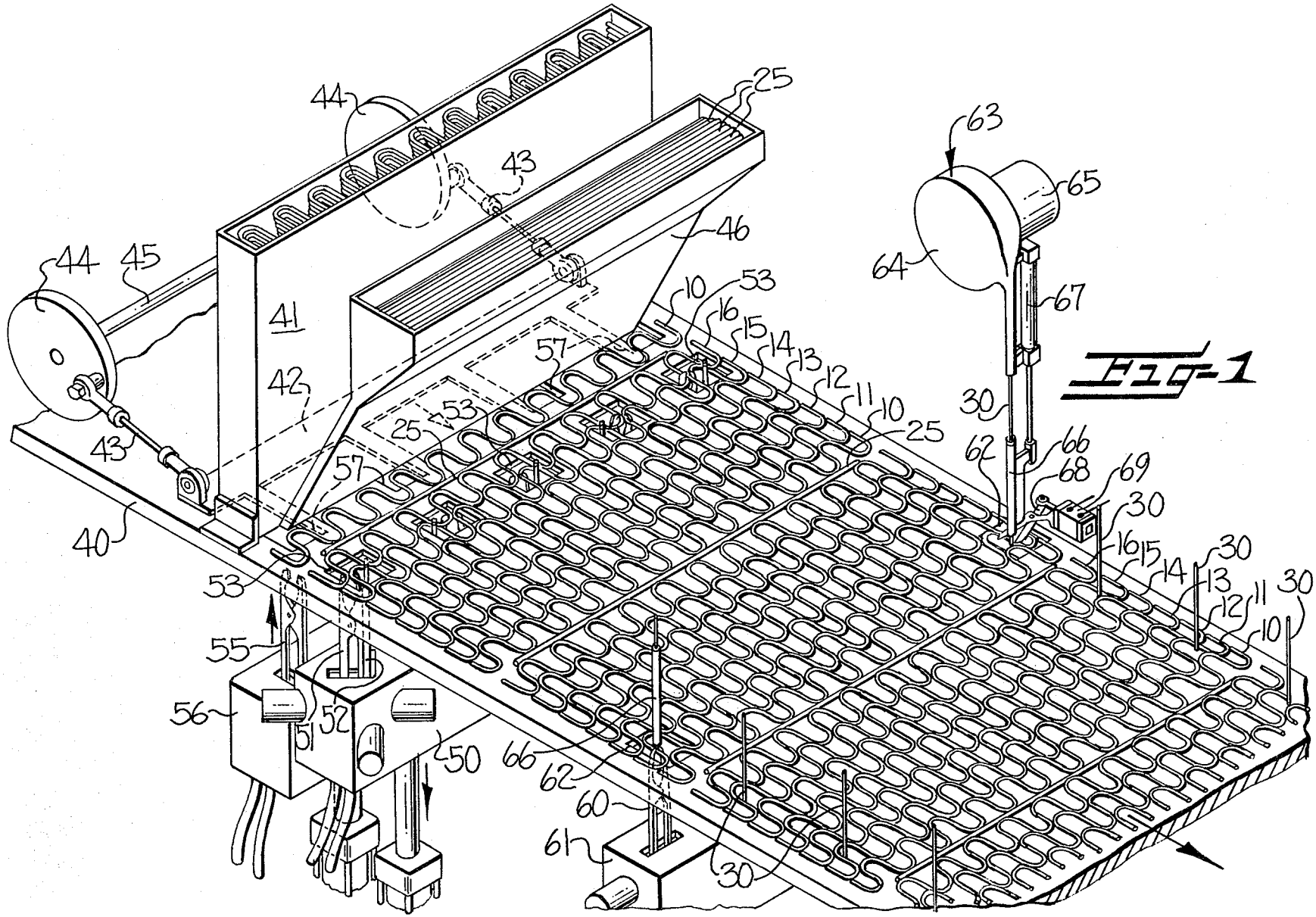
FIG. 1 is a somewhat schematic isometric view of one type of machine which may be utilized in forming the present seating spring assembly.

The seating spring assembly is preferably formed in an automatic manner and may be formed by the use of a machine of the type schematically illustrated in FIG. 1. This machine includes a spring wire feed or support bed 40 supporting the lower end of a spring wire supply chute 41 in which the sinuous spring wires 10–16 are vertically stacked. A spring wire feed plate 42 is supported for horizontal reciprocation on the feed plate 40. The feed plate 42 is reciprocated by connector links 43 connected to cam wheels 44 which are rotated in a step-by-step manner by a shaft 45. Each time the feed plate 42 is moved forwardly, it engages and moves the lowermost sinuous spring wire along the feed plate 40, pushing any preceding spring wires along the feed plate 40. An end wire supply chute 46 is provided for retaining a supply of the end wires 25 therein and for successively feeding the same, at the proper time, downwardly into a position in advance of the spring wire supply chute 40. The lower end of the end wire supply chute 46 is provided with a suitable gate type mechanism, not shown, for releasing a single back wire 25 at the proper timed location directly behind the endmost spring wire 16.

Figure 3:
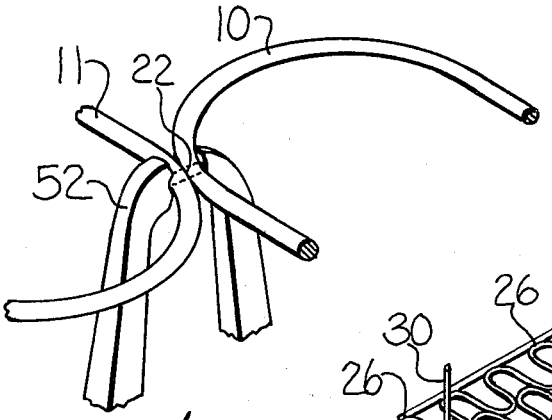
FIG. 3 is a fragmentary isometric view illustrating the manner in which one adjacent touching location of adjacent spring wires is spot welded together.

A series of clamping and spot welding electrodes 51, 52 (FIG. 3) is supported for operation on a vertically movable operating housing 50 (FIG. 1). Five pairs of such spot welding electrodes 51, 52 are illustrated in FIG. 1 as being supported on the housing 50 and the upper ends of one set of the spot welding and clamping electrodes is illustrated in FIG. 3 where the electrodes are shown in clamping position to form an intermediate spot weld 22 connecting the touching portions of adjacent spring wires 10 and 11. The clamping and spot welding electrodes 51, 52 are raised upwardly through spaced apart openings 53 in the feed plate 40 to secure each spring wire to the preceding spring wire by the spot welds 20, 21 and 22.

A series of four end wire clamping and spot welding electrodes, only one of which is illustrated at 55 in FIG. 1, is supported on an operating housing 56 which is supported for vertical movement in timed relationship to operation of the other parts of the machine. Suitable openings 57 are provided in the feed plate 40 for movement of the electrodes 55 upwardly therethrough and into clamping and spot welding position in the four locations spaced across the feed plate 40. A pair of clamping and spot welding electrodes 60 is provided at each side of the feed plate 40 and supported for operation in a vertically movable operating housing 61. The electrodes 60 are raised at the proper time and pass through openings 62 to spot weld the lower ends of the dip wires 30 to the spring assembly, in a manner to be presently described.

Dip wire feeding and positioning devices, broadly indicated at 63 are provided on each side of the feed plate, with only the right-hand device being shown in FIG. 1. This dip wire feed and positioning device 63 includes a housing 64 for supporting a supply spool of the dip wire material and a drive motor 65 for feeding the wire into a guide tube 66 through which the lower end of the dip wire 30 is directed. The guide tube 66 is supported for vertical reciprocation on the lower end of the operating piston of a fluid cylinder 67. A cutting device 68 is supported on the lower end of the guide tube 66 and is operated by a suitable solenoid 69. In order to maintain the sinuous spring wires in a flat and horizontally aligned position on the upper surface of the feed plate 40, an upper feed plate or spaced apart runners, not shown, may be provided in spaced relationship above the feed plate 40.

To form a spring assembly, the feed plate 42 is moved forwardly to engage and move the lowermost sinuous spring wire 10 forwardly along the feed plate 40 and against the straight end wire 25 of the preceding spring assembly. The next forward stroke of the feed plate 42 moves the next spring wire 11 forwardly and in nested relationship with the preceding spring wire 10. The clamping and spots welding electrodes 51, 52 are then raised to grip the adjacent touching spring wires 10, 11, as illustrated in FIG. 3 (at five pairs of locations across the feed plate 40), and form the spot welds 20, 21 at each end and the intermediate spot welds 22, thereby temporarily securing the spring wires 10, 11 together.

This process is repeated until the seven spring wires 10–16 have been fed forwardly. An end wire 25 is then released in front of the supply chute 41 and is positioned adjacent the endmost spring wire 16. The spot welding electrodes 55 are then raised and secure the end wire 25 to the endmost spring wire 16. The first spring wire 10 of the next spring assembly is then fed forwardly, as shown in FIG. 1, to push the end wire 25 forwardly and position the nested spring wires 15, 16 to be spot welded by the electrodes 51, 52. This completes the formation of one spring assembly.

Successive spring assemblies are moved along the feed plate 40 until the leading portion of a spring assembly is moved beneath the dip wire attaching device 63. The dip wires 30 are attached at their lower ends to the spring wire 11 by the electrodes 60 at opposite sides of the feed plate 40. When the trailing end of the spring assembly reaches this location, dip wires 30 are also attached to the spring wire 15 and adjacent the trailing portion of the spring assembly. The completed seating spring assemblies are successively fed from the end of the feed plate 40 and preheated, as previously described. The spring assemblies are then dipped into the plastic coating material C, illustrated as being contained in a tank 70 in FIG. 4, to apply the coating material thereto. The spring assemblies are then heated to cure the coating and the dip wires are removed.

Thus, the spring wires of the seating spring assembly are temporarily held in the proper relationship to each other by the spot welds at the touching locations at adjacent ends and at spaced locations intermediate the ends of each spring wire. The spring wires are maintained in the proper relationship while the plastic coating material is applied to the wires. When the spring assembly is secured to the frame of a seating device, such as a chair, the frangible welds break apart when the chair is occupied by a person and the full flexibility and comfort of the seating spring assembly is provided by the plastic coating which then constitutes the sole means holding the spring wires of the assembly together.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A seating spring assembly comprising (A) a series of elongate sinuous spring wires, each of said spring wires touching each of its adjacent spring wires at frequent intervals along their lengths, (B) frangible weld means provided at substantially the middle and at spaced apart additional touching locations intermediate opposite ends of adjacent spring wires, said frangible weld means temporarily securing together the touching locations of adjacent spring wires, and (C) a sleevelike plastic coating surrounding said spring wires and said frangible weld means, said plastic coating following the sinuosity of said spring wires and joining said spring wires together where said spring wires touch so that said spring wires, said frangible weld means, and said plastic coating comprise a unitary assembly, and whereby said frangible weld means is broken when said spring assembly is occupied by a person so that said plastic coating then constitutes the sole means holding said spring wires of said assembly together and the full flexibility and comfort of said seating spring assembly is retained.

2. A seating spring assembly according to claim 1 wherein said frangible weld means comprises spot welds.

3. A seating spring assembly according to claim 1 wherein each of said spring wires includes a series of U-shaped bends extending from one end to the other and wherein the U-shaped bends of one spring wire nest with the U-shaped bends of the next adjacent spring wire.

4. A seating spring assembly according to claim 1 including a straight wire extending along an endmost spring wire at one end of the spring assembly and in touching contact with said endmost spring wire, and frangible weld means at least at spaced apart locations intermediate opposite ends of said straight wire, said frangible weld means temporarily securing together the touching locations of said straight wire and said endmost spring wire.

5. A method of forming a seating spring assembly comprising the steps of (A) positioning a plurality of elongate sinuous spring wires in adjacent relationship with each spring wire touching each of its adjacent spring wires at frequent intervals along their lengths, (B) forming frangible welds at substantially the middle and at spaced apart touching additional locations intermediate opposite ends of adjacent spring wires to temporarily secure together adjacent spring wires of the spring assembly, and (C) forming a sleevelike plastic coating around the spring wires and the frangible welds so that the plastic coating follows the sinuosity of the spring wires and joins the spring wires together where the spring wires touch so that the spring wires, the frangible welds, and the plastic coating form a unitary assembly, and whereby the frangible welds are broken when the spring assembly is occupied by a person so that the plastic coating then constitutes the sole means holding the spring wires of the assembly together and the full flexibility and comfort of the seating spring assembly is retained.

6. A method according to claim 5 including the steps of positioning a straight wire in touching relationship with an endmost spring wire of the temporarily secured together spring wires, and forming frangible welds at least at spaced apart touching locations intermediate opposite ends of the straight wire.

7. A method according to claim 5 or 6 wherein the plastic coating is applied by a dipping operation and including the step of temporarily securing one end of a dip wire to the assembled spring wires by forming a frangible weld therebetween, the dip wire extending upwardly from the assembled spring wires and providing means for supporting the assembled spring wires during the dipping operation.

8. A method according to claim 7 wherein a dip wire is temporarily secured adjacent each corner of the assembled spring wires.

* * * * *